US011746557B2

(12) United States Patent
Huang

(10) Patent No.: US 11,746,557 B2
(45) Date of Patent: Sep. 5, 2023

(54) FENCE TYPE AUTOMATIC TENT

(71) Applicant: Yangfei Huang, Guangzhou (CN)

(72) Inventor: Yangfei Huang, Guangzhou (CN)

( * ) Notice: Subject to any disclaimer, the term of this patent is extended or adjusted under 35 U.S.C. 154(b) by 0 days.

(21) Appl. No.: 17/984,250

(22) Filed: Nov. 10, 2022

(65) Prior Publication Data

US 2023/0060437 A1 Mar. 2, 2023

(30) Foreign Application Priority Data

Oct. 25, 2022 (CN) ..... 202222819725.6

(51) Int. Cl.
*E04H 15/48* (2006.01)
*E04H 15/42* (2006.01)

(52) U.S. Cl.
CPC ..... *E04H 15/48* (2013.01); *E04H 15/42* (2013.01)

(58) Field of Classification Search
CPC ..... E04H 15/42; E04H 15/48
See application file for complete search history.

(56) References Cited

U.S. PATENT DOCUMENTS 7,509,967 B2 * 3/2009 Kim ..... E04H 15/48 135/120.2
7,607,447 B1 * 10/2009 Han ..... E04H 15/28 135/135
8,047,218 B1 * 11/2011 Shin ..... E04H 15/48 135/147
8,360,085 B2 * 1/2013 Lee ..... E04H 15/48 135/135
9,340,992 B2 * 5/2016 Huang ..... E04H 15/42
9,574,366 B2 * 2/2017 Choi ..... E04H 15/32
2014/0238456 A1 * 8/2014 Jin ..... E04H 15/48 135/147
2015/0252584 A1 9/2015 Kojima
2015/0330099 A1 11/2015 Zhou et al.
2016/0290003 A1 10/2016 Yang

FOREIGN PATENT DOCUMENTS

KR 200373088 Y1 * 1/2005
KR 20090083569 A * 8/2009
WO WO-2006101303 A1 * 9/2006 ..... E04H 15/28
WO WO-2009074042 A1 * 6/2009 ..... E04H 15/48

* cited by examiner

*Primary Examiner* — David R Dunn
*Assistant Examiner* — Danielle Jackson
(74) *Attorney, Agent, or Firm* — Zhigang Ma

(57) ABSTRACT

The present disclosure provides a fence type automatic tent, including a tent main body and a skeleton supporting plate arranged at a top end of the tent main body. The skeleton supporting plate is provided with a skeleton fixing plate and a locking switch handle in sequence. The locking switch handle is fixedly connected with the skeleton supporting plate. A periphery of the skeleton supporting plate extends outwards to form several stop bosses. To unfold the fence type automatic tent, a user presses the middle locking switch handle to separate the skeleton fixing plate from the skeleton supporting plate, so that an entire tent skeleton assembly can automatically spread under the action of an elastic force storage member.

10 Claims, 7 Drawing Sheets

A-A

B-B

FENCE TYPE AUTOMATIC TENT

TECHNICAL FIELD

The present disclosure relates to the technical field of tents, in particular, to a fence type automatic tent.

BACKGROUND

At present, an existing automatic retractable tent is extremely popular because of its advantages of being able to extend and retract like a folding umbrella, being convenient to assemble and disassemble, occupying a small space after it retracts, and being easy to carry.

However, in practice, it is found that most of the existing automatic retractable tents are unfolded by the elasticities of an unfolding and folding mechanism on a tent skeleton, which has the risk of self folding. Furthermore, the folding, of most of the automatic retractable tents is manually carried out, which also has certain risk in safety.

Therefore, it is necessary to provide, a fence type automatic tent to solve the above technical problems.

SUMMARY

The present disclosure overcomes the shortcomings in the above technology, and provides a fence type automatic tent.

In order to solve the above technical problem, the present disclosure adopts a technical solution to provide a fence type automatic tent, including a tent main body and a skeleton supporting plate arranged at a top end of the tent main body, Wherein the skeleton supporting plate is provided with a skeleton fixing plate and a locking switch handle in sequence from bottom to top; the locking switch handle is fixedly connected with the skeleton supporting plate; a periphery of the skeleton supporting plate extends outwards to form several stop bosses; gaps are reserved between adjacent ones of the limiting bosses; the skeleton fixing plate is fixedly connected with a tent skeleton assembly connected to the tent main body; the skeleton fixing plate is of an annular structure; an inner circle of the skeleton fixing plate downwards extends to form an annular inner plate; a periphery of the annular inner plate is provided with several first connectors fixedly connected to the tent skeleton assembly; lower end portions of the first connectors are abutted against upper end portions of the stop bosses; and an upper end portion of the tent skeleton assembly is provided with an elastic force storage member which supports the stop bosses such that the tent skeleton assembly is in an unfolded state.

In the fence type automatic tent according to the embodiment of the first aspect of the present disclosure, the skeleton supporting plate and the locking switch handle are fixedly connected through the annular inner plate; and the skeleton supporting plate and the locking switch handle move up and down on the skeleton fixing plate along the annular inner plate.

According to the fence type automatic tent of the embodiment of the first aspect of the present disclosure, each stop boss is a steplike boss in which an outer step is higher than an inner step; an end portion of the tent skeleton assembly supports the outer step; the elastic force storage member supports the inner step; and the tent skeleton assembly is folded when the elastic force storage member is located in the gap between two adjacent stop bosses.

According to the fence type automatic tent of the embodiment of the first aspect of the present disclosure, the tent skeleton assembly internally includes a lower supporting pipe and an upper supporting pipe hinged to an upper end portion of the lower supporting pipe. A tail end of the upper supporting pipe is provided with a skeleton connector fixedly connected to the skeleton fixing plate. The elastic force storage member is arranged on the skeleton connector.

According to the fence type automatic tent of the embodiment of the first aspect of the present disclosure, a lower end portion of the lower supporting pipe is provided with a foot pad. The foot pad is provided with an outwards protruding bottom connection portion used for being fixedly connected to the tent main body. An open hole is also formed in the footpad.

In the fence type automatic tent according to the embodiment of the first aspect of the present disclosure, the tent main body is provided with a main body connection portion fixedly connected to the tent skeleton assembly, the tent main body is of a polyhedral structure that is made of a gauze material. A reinforcing edge used for reinforcing the supporting strength of the tent main body is arranged at an edge of each surface of the tent main body. An upper end and a front end of the tent main body are respectively provided with zipper-like openings.

According to the fence type automatic tent of the embodiment of the first aspect of the present disclosure, the hinge member at the joint between the lower supporting pipe and the upper supporting pipe outwards protrudes to form a barb. A detachable light shield is arranged at an upper end portion of the locking switch handle in a covering manner. A tail end of the light shield is provided with a fourth connector cooperatively connected to the barb.

In the fence type automatic tent according to the embodiment of the first aspect of the present disclosure, a locking assembly fastened with the skeleton fixing plate to lock the skeleton supporting plate is arranged in the skeleton supporting plate; the locking assembly internally includes a locking button arranged outside the skeleton supporting plate and a fastener arranged inside the skeleton supporting plate; the fastener is connected to a lower end portion of the locking button; an opening for allowing the locking button to pass is formed in the locking switch handle; and an elastic extension and retraction member used for pushing the fastener) to be fastened on the skeleton fixing plate is arranged between the fastener and the skeleton supporting plate.

According to the fence type automatic tent of the embodiment of the first aspect of the present disclosure, the fastener is of a rectangular structure. The open hole in which the elastic extension and retraction member is arranged is formed in the fastener. One portion of the elastic extension and retraction member is arranged in the open hole, and the other portion is arranged outside the open hole and is abutted against the skeleton supporting plate. The fastener outwards extends to form a protruding member. A groove in which the protruding member is clamped is arranged on the skeleton fixing plate.

According to the fence type automatic tent of the embodiment of the first aspect of the present disclosure, a lower end portion of the locking button is provided with an upwards sunken second groove. An upper end portion of the fastener upwards protrudes to form a second protruding member clamped into the second groove. An upwards extending baffle plate is arranged on the fastener. The baffle plate is abutted against an outer side of a rear end of the button.

Compared with the prior art, the present disclosure has the following beneficial effects.

To unfold the fence type automatic tent, a user presses the middle locking switch handle to separate the skeleton fixing plate from the skeleton supporting plate, so that an entire tent skeleton assembly can automatically spread under the action of an elastic force storage member. The user then downwards compresses the skeleton fixing plate, and rotates and locks the skeleton fixing plate and the skeleton supporting plate, so that an end portion of the tent skeleton assembly is in a horizontal state between the skeleton fixing plate and the skeleton supporting plate. The user locks the skeleton fixing plate and the skeleton supporting plate to fix the automatic tent in the unfolded state.

DETAILED DESCRIPTION OF THE EMBODIMENTS

Figure 1:
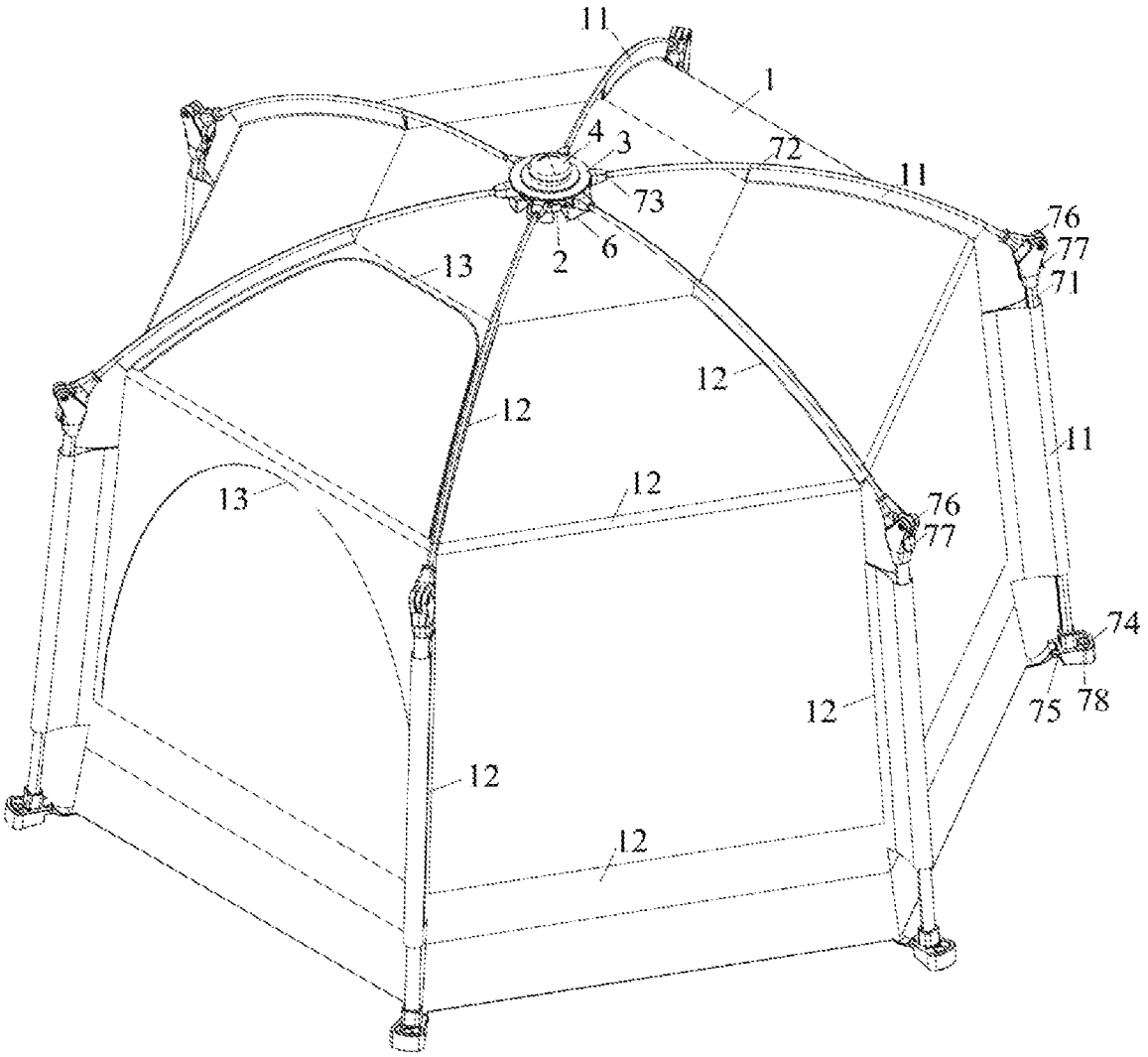
FIG. 1 is a structural diagram of assembling of a fence type automatic tent according to the present disclosure.
Figure 2:
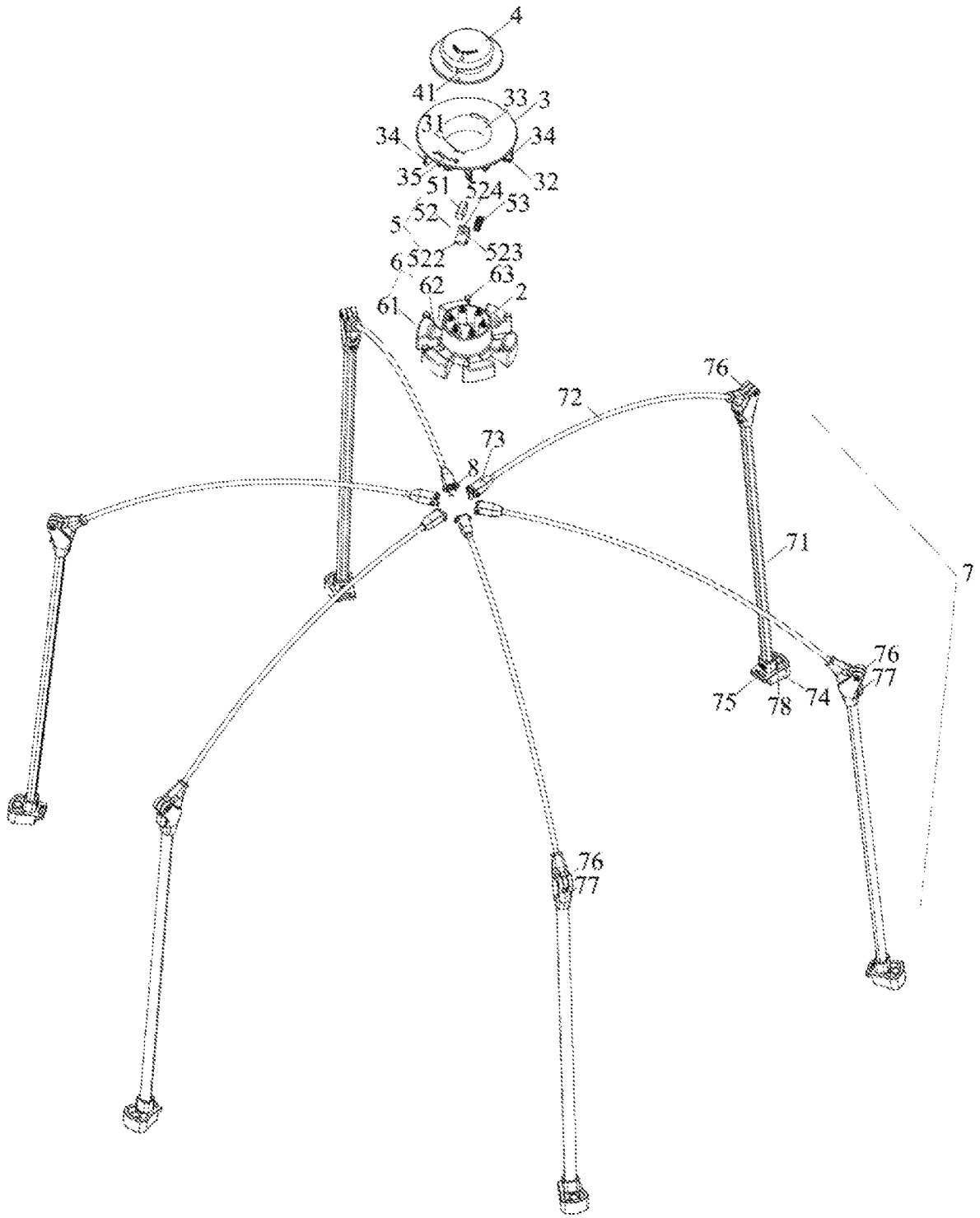
FIG. 2 is a structural exploded diagram of a fence type automatic tent with a locking assembly.
Figure 3:
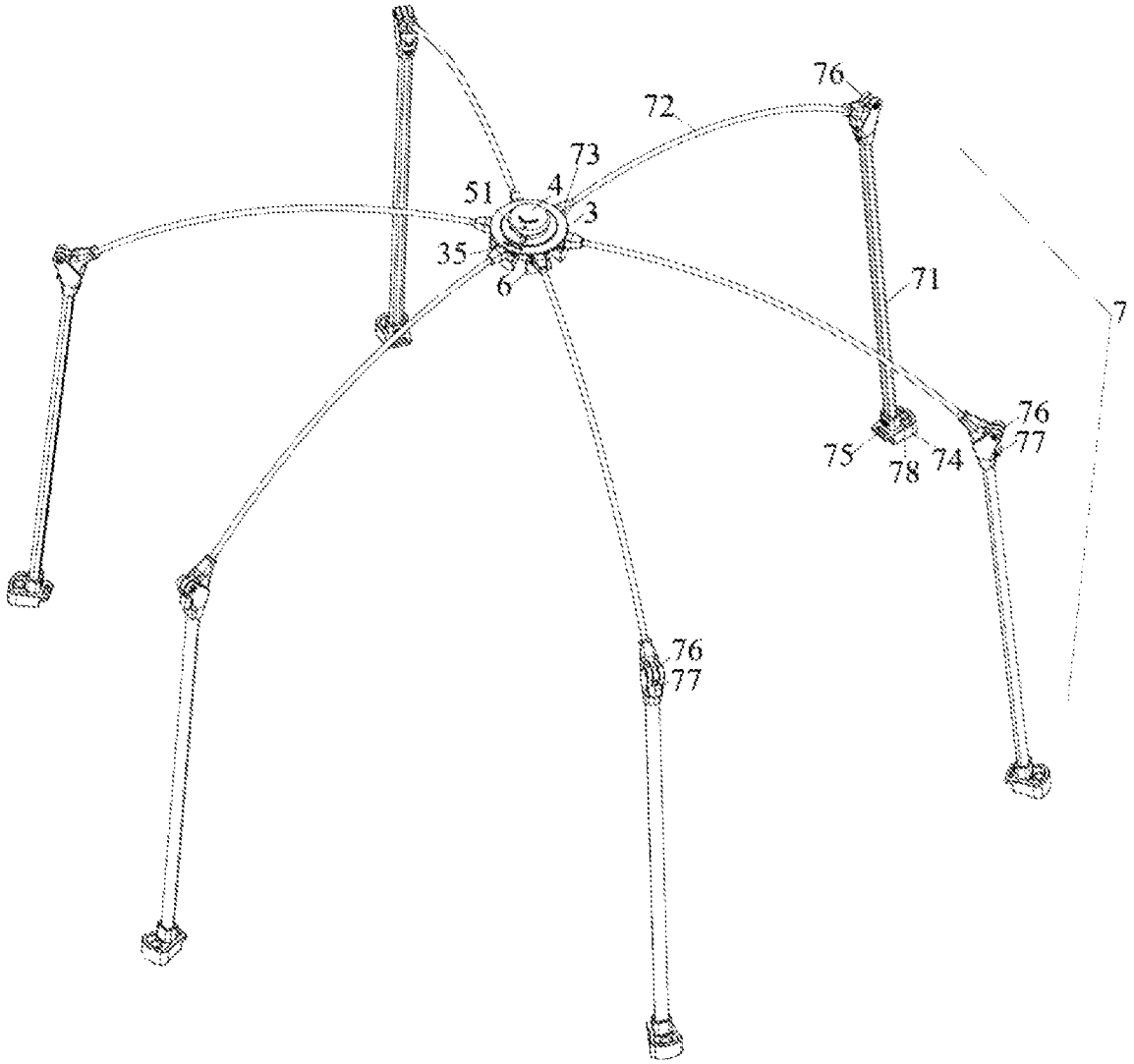
FIG. 3 is a structural diagram of assembling shown in FIG. 2.
Figure 4:
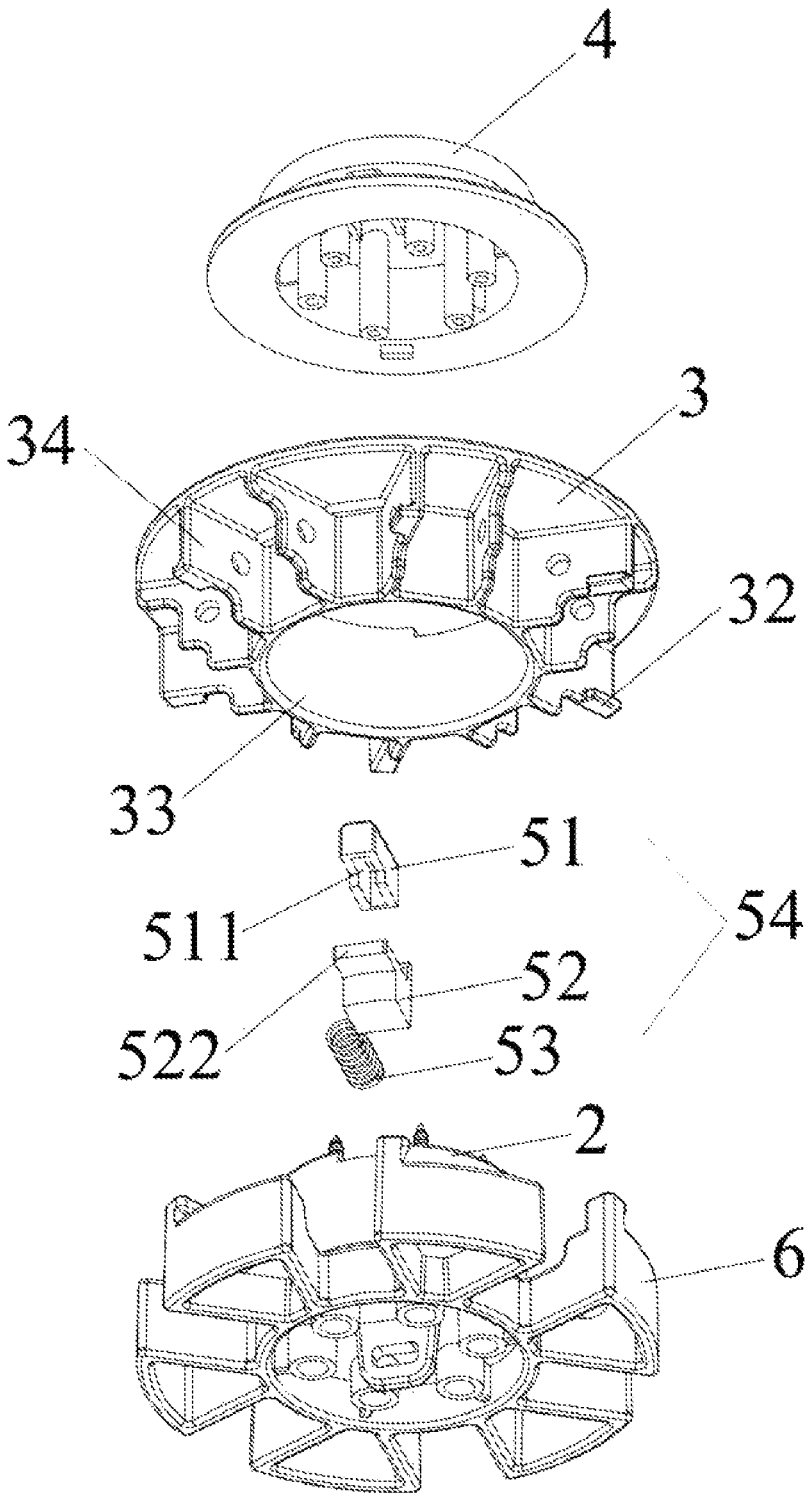
FIG. 4 is an exploded structural diagram of the skeleton supporting plate, the skeleton fixing plate, the locking, switch handle, the locking assembly, and the stop boss shown in FIG. 1.
Figure 5:
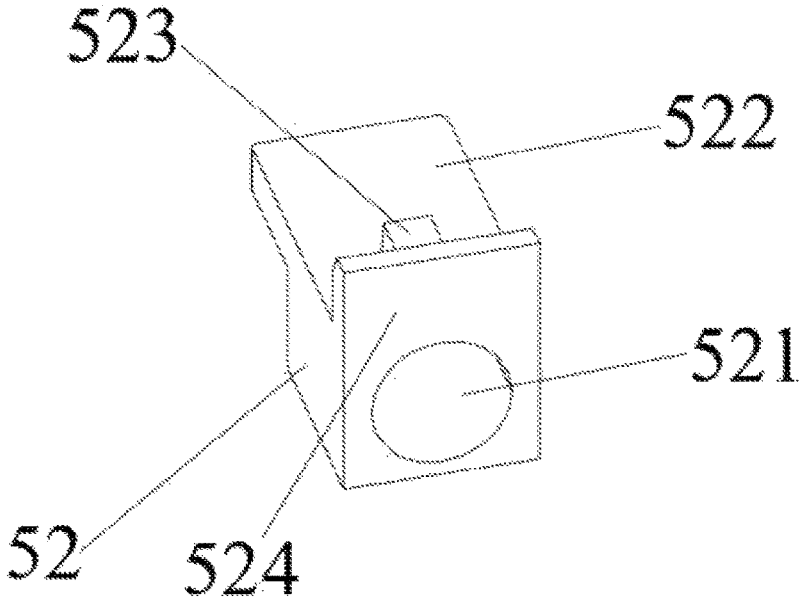
FIG. 5 is a structural diagram of a fastener shown in FIG. 4.
Figure 6:
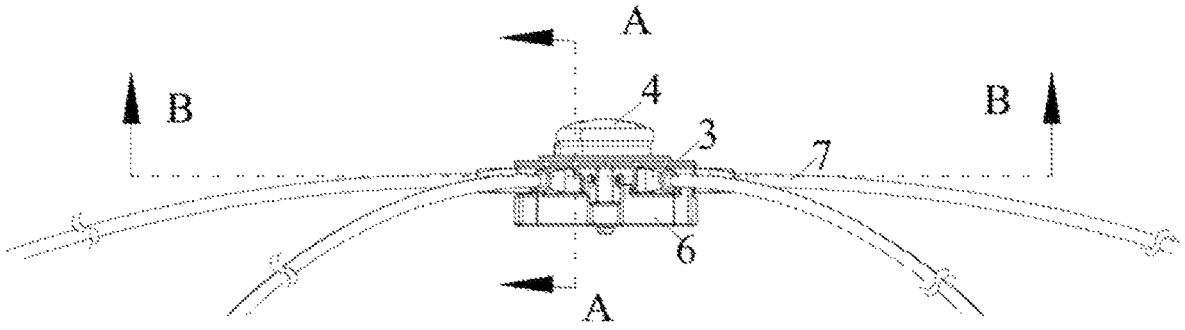
FIG. 6 is a structural front view shown in FIG. 2.
Figure 7:
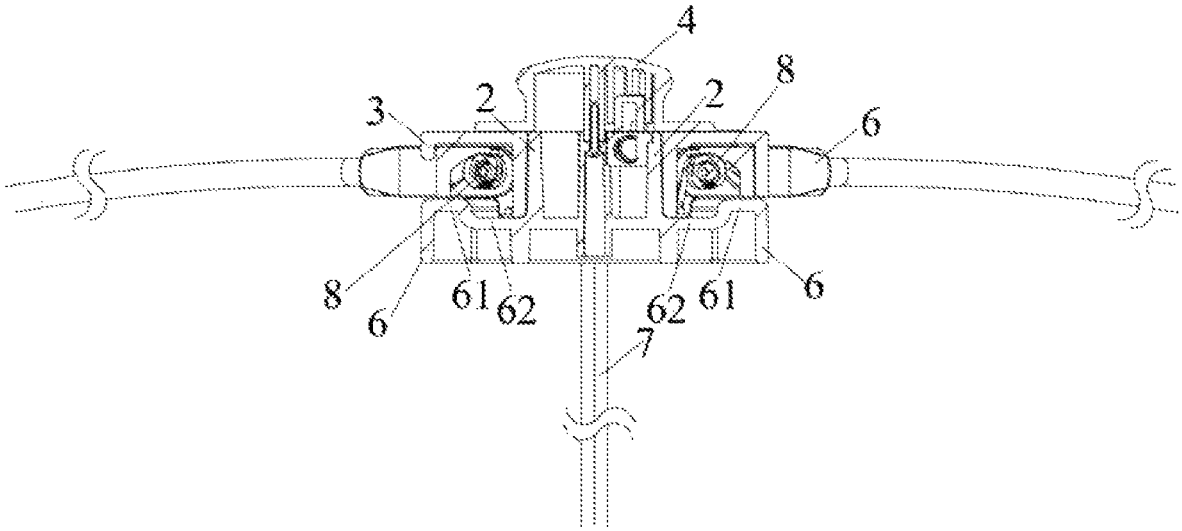
FIG. 7 is a structural sectional view shown in FIG. 6.
Figure 8:
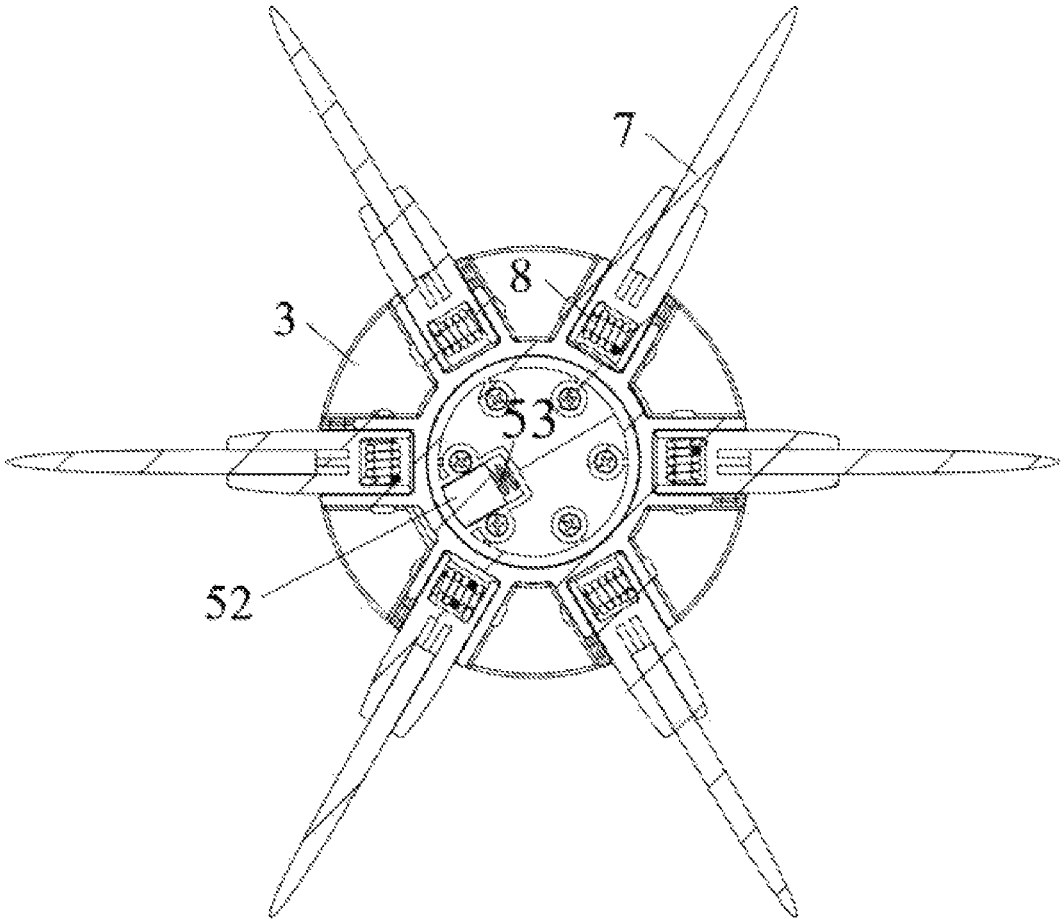
FIG. 8 is a structural sectional view of position B shown in FIG. 6.

Referring to FIG. 1 to FIG. 8, a fence type automatic tent of this embodiment includes a tent main body 1 and a skeleton supporting plate 2 arranged at a top end of the tent main body 1. The skeleton supporting plate 2 is provided with a skeleton fixing plate 3 and a locking switch handle 4 in sequence from bottom to top. The locking switch handle 4 is fixedly connected with the skeleton supporting plate 2. A locking assembly 5 fastened with the skeleton fixing plate 3 to lock the skeleton supporting plate 2 is arranged in the skeleton supporting plate 2. A periphery of the skeleton supporting plate 2 extends outwards to form several stop bosses 6, gaps are reserved between adjacent ones of the stop bosses 6. The skeleton fixing plate 3 is fixedly connected with a tent skeleton assembly 7 connected to the tent main body 1, the skeleton fixing plate 3 is of an annular structure. An inner circle of the skeleton fixing plate 3 downwards extends to form an annular inner plate 33. A periphery of the annular inner plate 33 is provided with several first connectors 34 fixedly connected to the tent skeleton assembly 7. Lower end portions of the first connectors 34 are abutted against upper end portions of the stop bosses 6, an upper end portion of the tent skeleton assembly 7 is provided with an elastic force storage member 8 which supports the stop bosses 6 such that the tent skeleton assembly 7 is in an unfolded state.

To unfold the fence type automatic tent, a user presses the middle locking switch, handle to separate the skeleton fixing plate 3 from the skeleton supporting plate 2, so that the entire tent skeleton assembly 7 can automatically spread under the action of the elastic force storage member 8. The user then downwards compresses the skeleton, fixing plate 3, and rotates and locks the skeleton fixing plate 3 and the skeleton supporting plate 2, so that an end portion of the tent skeleton assembly 7 is in a horizontal state between the skeleton fixing plate 3 and the skeleton supporting plate 2. The user locks the skeleton fixing plate 3 and the skeleton supporting plate 2 to fix the automatic tent in the unfolded state.

Preferably, the skeleton supporting plate 2 and the locking switch handle 4 are fixedly connected through the annular inner plate 33; and the skeleton supporting plate 2 and the locking switch handle 4 move up and down on the skeleton fixing plate 3 along the annular inner plate 33.

Preferably, each stop boss 6 is a steplike boss in which an outer step 61 is higher than an inner step 62; an end portion of the tent skeleton assembly 7 supports the outer step 61; the elastic force storage member 8 supports the inner step 62; and the tent skeleton assembly 7 is folded when the elastic force storage member 8 is located in the gap between two adjacent stop bosses 6.

In the embodiment of the present disclosure, when the tent skeleton assembly 7 is bundled in a collapsed state, the user can hold the locking switch handle 4 and lift it up after untying a tie. At this time, the elastic force storage member 8 is abutted against the gap between two adjacent stop bosses 6 and can be slightly outwards spread to drive the tent skeleton assembly 7 to be unfolded towards a radial direction. After a mesh is driven to be opened to a certain position, the user can place the entire tent on a flat surface (which is usually the ground), and then press the locking switch handle 4 until an outer upper plane of an upper end portion of the tent skeleton assembly 7 overlaps a horizontal plane at a joint of the skeleton, fixing plate 3. While pressing the locking switch handle 4, the user rotates the locking switch handle 4 to a locking position towards a locking mark direction on a surface of the skeleton fixing plate 3 and then releases it. At this time, the locking assembly 5 will be fastened on the skeleton fixing plate 3. The locking switch handle 4 and the skeleton supporting plate 2 are locked by the locking assembly 5 and are unable to rotate. At this time, the entire tent main body 1 will be spread (unfolded).

In the embodiment of the present disclosure, when the tent main body 1 is spread, the locking assembly 5 is arranged to enable the locking switch handle 4 and the skeleton supporting plate 2 to achieve an effect of preventing rotation, so that the risk of failure in normal use when the opened tent main body 1 is closed due to other reasons.

In the embodiment of the present disclosure, to pack up the tent, the user can press the locking assembly 5 towards the arrow direction when pressing the locking switch handle 4, so that one end of the locking assembly 5 is separated from an internal groove of the skeleton fixing plate 3. The user rotates the locking switch handle 4 to a specified position according to an, unlocking mark direction and then releases it. The elastic force storage member 8 will move from the stop bosses 6 to a vertical gap between two adjacent stop bosses 6, so that the elastic force storage member 8 is no longer stopped and fixed. At this time, the tent can be bundled with the tie after the tent skeleton assembly 7 is closed towards a center direction.

In the embodiment of the present disclosure, the fence type automatic tent of the present disclosure can be applied to multiple different fields. For example, when the tent main body 1 is small in size, the tent can be used as a children fence used indoor. When the tent main body 1 is large in size, the tent can be used as an outdoor tent used outdoor. The present disclosure does not make any limitation.

Preferably, the tent skeleton assembly 7 internally includes a lower supporting pipe 71 and an upper supporting pipe 72 hinged to an upper end portion of the lower supporting pipe. A tail end of the upper supporting pipe 72 is provided with a skeleton connector 73 fixedly connected to the skeleton fixing plate 3. The elastic force storage member 8 is arranged on the skeleton connector 73.

In the embodiment of the present disclosure, the elastic force storage member 8 in the present disclosure may be an elastic member such as a torsional, spring which has a force storage function. The torsional spring is used as an example. When the skeleton connector 73 is fixed on the skeleton fixing plate 3 through female and male screws, the torsional spring can pass through the female and male screws and be arranged on the skeleton connector 73. At this time, since the tent skeleton assembly 7 is unfolded, one portion of the torsional spring is arranged on the skeleton connector 73, and the other portion supports the stop bosses 6. At this time, the skeleton connector 73 also supports the stop bosses 6. If the tent skeleton assembly 7 is folded at this time, the skeleton connector 73 and the other portion of the torsional spring are supported between two adjacent stop bosses 6.

Preferably, a lower end portion of the lower supporting pipe 71 is provided with a foot pad 74. The foot pad 74 is provided with an outwards protruding bottom connection portion 75 used for being fixedly connected to the tent main body 1. An open hole 78 is also formed in the foot pad 74.

In the embodiment of the present disclosure, a lower end portion of the tent main body 1 may be provided with a rope. The rope can pass through the bottom connection portion 75 on the foot pad 74 and be fixedly arranged on the tent skeleton assembly 7, thus reinforcing the entire tent, and the tent is difficult to deform during use.

In the embodiment of the present disclosure, an open hole 78 may be formed in the foot pad 74. When the tent is used outdoor, the open hole 78 can cooperate with a nail accessory to fix the whole fence on the ground and prevent the fence from being blown or moved by wind.

Preferably, a main body connection portion 11 fixedly connected to the tent skeleton assembly 7 is arranged on the tent main body 1.

In the embodiment of the present disclosure, the lower supporting pipe 71 and the upper supporting pipe 72 may be fixed on the tent main body 1 through the main body connection portion 11 on the tent main body 1. Meanwhile, a hinge member 76 at a joint between the lower supporting pipe 71 and the upper supporting pipe 72 may be arranged outside the main body connection portion 11 in the form of a corner angle.

Preferably, the tent main body 1 is of a polyhedral, structure that is made of a gauze material. A reinforcing edge 12 used for, reinforcing the supporting strength of the tent main body 1 is arranged at an edge of each surface of the tent main body 1.

In the embodiment of the present disclosure, the tent main body 1 made of the gauze material occupies a small storage volume after being folded. The gauze material is ventilated and light-transmittable, and also overall features with light weight.

In the embodiment of the present disclosure, in order to prevent such a phenomenon that an extremely light tent main body 1 that is overall made of the gauze material has no supporting strength and to enable the whole tent main body 1 to have the advantages of light weight, small volume, ventilation and light transmittance, the edge of each surface of the tent main body 1 is sewed with one reinforcing edge 12, which can strengthen the whole tent. Therefore, the tent is difficult to deform during use and has the advantages of simple structure, stable performance and long service life.

Preferably, an upper end and a front end of the tent main body 1 are respectively provided with zipper-like openings 13.

In the embodiment of the present disclosure, when the tent is used as a children fence, a zipper puller on the zipper-like opening 13 may be arranged outside the tent main body 1, so that it is very hard to open the opening from the inside. In this way, when a baby is put into the tent main body 1, the baby can be effectively prevented from opening the zipper at the front end of the tent main body 1 by himself and climbing out of the tent. Small objects can be fetched after the zipper-like opening at the upper end of the tent main body 1 is opened from outside.

Preferably, the hinge member 76 at the joint between the lower supporting pipe 71 and the upper supporting pipe 72 outwards protrudes to form a barb 77. A detachable light shield is arranged at an upper end portion of the locking switch handle 4 in a covering manner. A tail end of the light shield is provided with a fourth connector cooperatively connected to the barb 77.

In the embodiment of the present disclosure, when the present disclosure is used as the children fence indoor, since there is lamplight indoor, no shield is required. At this time, the light shield can be removed. Since the whole tent main body 1 is made of the gauze material, the top end of the tent main body 1 is light-transmittable and ventilated. When the present disclosure is used as an outdoor tent, the light shield can shield the sunlight.

In the embodiment of the present disclosure, the fourth connector of the present disclosure may be a rope structure arranged at the tail end of the light shield. After the light shield covers the upper end portion of the locking switch handle 4, the rope can be hooked on the barb 77 for stable co operation.

Preferably, the locking assembly 5 internally includes a locking button 51 arranged outside the skeleton supporting plate 2 and a fastener 52 arranged inside the skeleton supporting plate 2. The fastener 52 is connected to a lower end portion of the locking button 51. An opening 41 for allowing the locking button 51 to pass is formed in the locking switch handle 4. An elastic extension and retraction member 53 used for pushing the fastener 52 to be fastened on the skeleton fixing plate 3 is arranged between the fastener 52 and the skeleton supporting plate 2.

In the embodiment of the present disclosure, the skeleton supporting plate 2 can pass through the skeleton fixing plate 3 and be fixed with the locking switch handle 4 by a screw. Meanwhile, the skeleton supporting plate 2 is internally provided with a mounting slot for mounting the fastener 52. After the elastic extension and retraction member 53 is placed in a corresponding open hole 521 of the fastener 52, the fastener 52 and the elastic extension and retraction member 53 are placed in the corresponding mounting slot of the skeleton supporting plate 2 together. After the locking button 51 is placed in the corresponding opening of the locking switch handle 4, the locking switch handle 4 can then be fixed to a corresponding position on the skeleton supporting plate 2 by a screw. At this time, the skeleton fixing plate 3 should be between the skeleton supporting plate 2 and the locking switch handle 4. Meanwhile, the elastic force storage member 8 should be radially abutted between the stop bosses 6 and the skeleton supporting plate 2 in a limited manner, so that the tent skeleton assembly 7 is unfolded.

Preferably, the fastener 52 is of a rectangular structure. The open hole 521 in which the elastic extension and refraction member 53 is, arranged is formed in the fastener 52. One portion of the elastic extension and retraction member 53 is arranged in the open hole 521, and the other portion is arranged outside the open hole 521 and is abutted against the skeleton supporting plate 2. The fastener 52 outwards extends to form a protruding member 522. A groove 31 in which the protruding member 522 is clamped is arranged on the skeleton fixing plate 3.

In the embodiment of the present disclosure, to unfold the tent for use, when pressing the locking switch handle 4, the user can rotate the locking switch handle 4 towards the locking mark direction on the surface of the skeleton fixing plate 3 to the locking position and release it. At this time, a front end of the protruding member 522 will be clamped in the groove 31 under the action of the elastic extension and retraction member 53. At this time, the locking switch handle 4 and the skeleton supporting plate 2 are locked by the protruding member 522 and are unable to rotate. The elastic force storage member 8 is arranged between the stop bosses 6 and the skeleton supporting plate 2 in a maximum angle, so that the entire tent skeleton assembly 7 is spread (unfolded). At, the same time, the entire tent is spread under the action of counter-acting forces of the arc-shaped upper supporting pipe 72 and lower supporting pipe 71.

Preferably, a lower end portion of the locking button 51 is provided with an upwards sunken second groove 511. An upper end portion of the fastener 52 upwards protrudes to form a second protruding member 523 clamped into the second groove 511. An upwards extending baffle plate 524 is arranged on the fastener 52. The baffle plate 524 is abutted against an outer side of a rear end of the locking button 51.

In the embodiment of the present disclosure, the locking button 51 rotates with the rotation of the locking switch handle 4. When the locking switch handle 4 is rotated, the second groove 511 may drive the second protruding member 523 clamped therein to rotate together, thus driving the entire fastener 52 to rotate.

In the embodiment of the present disclosure, when the locking button 51 is pressed, a rear end of the locking button 51 may push the baffle plate 524 to move backwards, i.e., push the entire fastener 52 to move backwards. When the locking switch handle is rotated until an unlocked state is achieved, the locking button 51 that is pressed all the time is released. At this time, under the action of the elastic extension and retraction member 53, the fastener 52 may be pushed to be abutted against an inner side wall of the skeleton supporting plate 2.

Preferably, each stop boss 6 is a steplike boss in which an outer step 61 is higher than an inner step 62. The skeleton connector 73 supports the outer step 61 when the locking assembly 5 is fastened on the skeleton fixing plate 3. The elastic force storage, member 8 supports the inner step 62 when the locking assembly 5 is fastened on the skeleton fixing plate 3. When the locking assembly 5 is not fastened on the fixing plate 3, the elastic force storage member 8 is arranged between two adjacent stop bosses 6 such that the tent skeleton assembly 7 is folded.

Preferably, the outer step 61 upwards extends to form an inverted L-shaped protruding member 63. The lower end portion of the skeleton fixing plate 3 downwards extends to form a reverse L-shaped hook 32 used for being fastened to the inverted L-shaped protruding member 63 when the locking assembly 5 is fastened on the skeleton fixing plate 3.

In this embodiment, the skeleton supporting plate 2 and the skeleton fixing plate 3 are respectively provided with the inverted L-shaped protruding member 63 and the reverse L-shaped hook 32, so that the skeleton supporting plate 2 and the skeleton fixing plate 3 will be engaged with each other after being rotated in place. The inverted L-shaped protruding member 63 and the reverse L-shaped hook 32 can enhance the cooperation strength with the skeleton fixing plate 3 when the skeleton supporting plate 2 supports the tent skeleton assembly 7, so that the strength of a product is greatly improved.

Preferably, the skeleton fixing plate 3 is of an annular structure. An inner circle of the skeleton fixing plate 3 downwards extends to form an annular inner plate 33. A periphery of the annular inner plate 33 is provided with several first connectors 34 fixedly connected to the tent skeleton assembly 7. Lower end portions of the first connectors 34 are abutted against upper end portions of the stop bosses 6. One portion of the skeleton supporting plate 2 is arranged inside the annular inner plate 33, and the other portion is arranged outside the annular inner plate 33.

Preferably, an indicator 35 used for instructing the locking switch handle 4 to be rotated to the locked state is arranged on the skeleton fixing plate 3.

The above descriptions are only the embodiments of the present disclosure, and are not intended to limit the patent scope of the present disclosure. Any equivalent structure made by using the content of the specification and drawings of the present disclosure and directly or indirectly applied to related technical fields shall all similarly fall within the scope of patent protection of the present disclosure.

What is claimed is:

1. An automatic tent, comprising a tent main body (1) and a skeleton supporting plate (2) arranged at a top end of the tent main body (1), wherein the skeleton supporting plate (2) is provided with a skeleton fixing plate (3) and a locking switch handle (4) in sequence from bottom to top; the locking switch handle (4) is fixedly connected with the skeleton supporting plate (2); a periphery of the skeleton supporting plate (2) extends outwards to form several stop bosses (6); gaps are reserved between adjacent ones of the stop bosses (6); the skeleton fixing plate (3) is fixedly connected with a tent skeleton assembly (7) connected to the tent main body (1); the skeleton fixing plate (3) is of an annular structure, an inner circle of the skeleton fixing plate (3) extends downward to form an annular inner plate (33); a periphery of the annular inner plate (33) is provided with several first connectors (34) fixedly connected to the tent skeleton assembly (7); lower end portions of the first connectors (34) are abutted against upper end portions of the stop bosses (6); and an upper end portion of the tent skeleton assembly (7) is provided with an elastic force storage member (8) which resists against the stop bosses (6) when the tent skeleton assembly (7) is in an unfolded state.

2. The automatic tent according to claim 1, wherein the skeleton supporting plate (2) and the locking switch handle (4) are fixedly connected to each other in a hollow portion inside of the annular inner plate (33); and the skeleton supporting plate (2) and the locking switch handle (4) move up and down on the skeleton fixing plate (3) along the annular inner plate (33).

3. The automatic tent according to claim 2, wherein each stop boss (6) is a steplike boss in which an outer step (61) is higher than an inner step (62); an end portion of the tent skeleton assembly (7) resists against the outer step (61) and the elastic force storage member (8) resists against the inner step (62) when the tent skeleton assembly (7) is in the unfolded state; and the tent skeleton assembly (7) is folded when the elastic force storage member (8) is located in the gap between two adjacent stop bosses (6).

4. The automatic tent according to claim 1, wherein the tent skeleton assembly (7) comprises a lower supporting pipe (71) and an upper supporting pipe (72) hinged to an upper end portion of the lower supporting pipe; a tail end of the upper supporting pipe (72) is provided with a skeleton connector (73) fixedly connected to the skeleton fixing plate (3); and the elastic force storage member 8 is arranged on the skeleton connector (73).

5. The automatic tent according to claim 4, wherein a lower end portion of the lower supporting pipe (71) is provided with a foot pad (74); the foot pad (74) is provided with an outwards protruding bottom connection portion (75) used for being fixedly connected to the tent main body (1); and an open hole (78) is also formed in the foot pad (74).

6. The automatic tent according to claim 1, wherein a main body connection portion (11) fixedly connected to the tent skeleton assembly (7) is arranged on the tent main body 1; the tent main body (1) is of a polyhedral structure that is made of a gauze material; a reinforcing edge (12) used for reinforcing a supporting strength of the tent main body (1) is arranged at an edge of each surface of the tent main body (1); and an upper end and a front end of the tent main body (1) are respectively provided with window openings (13) configured to be opened or closed through a zipper.

7. The automatic tent according to claim 4, wherein a hinge member (76) at the joint between the lower supporting pipe (71) and the upper supporting pipe (72) protrudes outward to form a barb (77), a detachable light shield is arranged at an upper end portion of the locking switch handle (4) in a covering manner; and a tail end of the light shield is provided with a fourth connector cooperatively connected to the barb (77).

8. The automatic tent according to any one according to claim 1, wherein a locking assembly (5) fastened with the skeleton fixing plate (3) to lock the skeleton supporting plate (2) is arranged in the skeleton supporting plate (2); the locking assembly (5) comprises a locking button (51) arranged outside the skeleton supporting plate (2) and a fastener (52) arranged inside the skeleton supporting plate (2); the fastener (52) is connected to a lower end portion of the locking button (51); an opening (41) for allowing the locking button (51) to pass is formed in the locking switch handle (4); and an elastic extension and retraction member (53) used for pushing the fastener (52) to be fastened on the skeleton fixing plate (3) is arranged between the fastener (52) and the skeleton supporting plate (2).

9. The automatic tent according to claim 8, wherein the fastener (52) is of a rectangular structure; an open hole (521) in which the elastic extension and retraction member (53) is arranged is formed in the fastener (52); one portion of the elastic extension and retraction member (53) is arranged in the open hole (521), and the other portion is arranged outside the open hole (521) and is abutted against the skeleton supporting plate (2); the fastener (52) extends outward to form a protruding member (522); and a groove (31) in which the protruding member (522) is clamped is arranged on the skeleton fixing plate (3).

10. The automatic tent according to claim 8, wherein a lower end portion of the locking button (51) is provided with an upwards sunken second groove (511); an upper end portion of the fastener (52) protrudes upward to form a second protruding member (523) clamped into the second groove (511); an upwards extending baffle plate (524) is arranged on the fastener (52); and the baffle plate (524) is abutted against an outer side of a rear end of the locking button (51).

* * * * *